US008474228B2

(12) United States Patent
Adair et al.

(10) Patent No.: US 8,474,228 B2
(45) Date of Patent: Jul. 2, 2013

(54) PACKAGING SYSTEMS AND METHODS FOR TRANSPORTING VIALS

(75) Inventors: Nicholas Adair, San Francisco, CA (US); Joselito Crespo, Burlingame, CA (US); Allen Perry, Redwood City, CA (US); Paul Russell, Campbell, CA (US)

(73) Assignee: Life Technologies Corporation, Carlsbad, CA (US)

( * ) Notice: Subject to any disclaimer, the term of this patent is extended or adjusted under 35 U.S.C. 154(b) by 235 days.

(21) Appl. No.: 12/633,751

(22) Filed: Dec. 8, 2009

(65) Prior Publication Data

US 2011/0132797 A1 Jun. 9, 2011

(51) Int. Cl.
*B65B 1/04* (2006.01)

(52) U.S. Cl.
USPC ..... 53/473; 53/171; 53/158; 53/540

(58) Field of Classification Search
USPC ..... 53/171, 158, 473, 474, 540
See application file for complete search history.

(56) References Cited

U.S. PATENT DOCUMENTS

| | | | | |
|---|---|---|---|---|
| 4,240,547 | A | 12/1980 | Taylor | |
| 4,867,315 | A | 9/1989 | Baldwin | |
| 4,997,090 | A | 3/1991 | Lenmark, Sr. et al. | |
| 5,040,678 | A | 8/1991 | Lenmark, Sr. et al. | |
| 5,271,209 | A * | 12/1993 | Boyhan | 53/473 |
| 5,833,057 | A | 11/1998 | Char et al. | |
| 6,161,687 | A | 12/2000 | Hacikyan | |
| 6,221,027 | B1 * | 4/2001 | Pitesky | 600/556 |
| 6,258,041 | B1 * | 7/2001 | Pitesky | 600/556 |
| 7,278,328 | B2 * | 10/2007 | Massaro | 73/863.01 |
| 7,734,374 | B2 * | 6/2010 | Dallman | 700/242 |
| 2003/0029140 | A1 * | 2/2003 | Hirschek | 53/447 |
| 2004/0011871 | A1 * | 1/2004 | Harper et al. | 235/462.01 |
| 2005/0058574 | A1 * | 3/2005 | Bysouth et al. | 422/63 |
| 2006/0051239 | A1 * | 3/2006 | Massaro | 422/63 |
| 2007/0272587 | A1 | 11/2007 | Nguyen et al. | |
| 2008/0164273 | A1 * | 7/2008 | Dallman | 221/2 |
| 2010/0243509 | A1 * | 9/2010 | Gelardi | 206/536 |

FOREIGN PATENT DOCUMENTS

| | | |
|---|---|---|
| JP | 08-058845 | 3/1996 |
| JP | 10-123147 | 5/1998 |

OTHER PUBLICATIONS

International Search Report for Int'l Application No. PCT/US10/059573 dated Jul. 28, 2011, along with the Written Opinion of the Searching Authority.

* cited by examiner

*Primary Examiner* — Hemant M Desai

(57) ABSTRACT

A packaging system for transporting vials containing biological samples may comprise a first tray defining at least one first tray cavity; and a second tray defining at least one second tray cavity and configured to mate with the first tray. The packaging system may further comprise at least one first tray cavity and at least one second tray cavity, wherein the at least one first tray cavity and the at least one second tray cavity are configured to securely hold respective vials for transport, and to restrain caps on the respective vials during transport, wherein the at least one first tray cavity and the at least one second tray cavity oppose each other when the first tray and the second tray are mated together. The packaging system may also be configured to permit barcode scanning of vials held within the first tray cavity and the second tray cavity.

10 Claims, 8 Drawing Sheets

PACKAGING SYSTEMS AND METHODS FOR TRANSPORTING VIALS

TECHNICAL FIELD

The present teachings relate to packaging systems and methods for transporting vials. More particularly, the present teachings relate to packaging systems and methods for transporting vials containing liquid samples, such as, for example, oligonucleotide samples, useful for biological, chemical, and/or cytobiological applications.

INTRODUCTION

The section headings used herein are for organizational purposes only and are not to be construed as limiting the subject matter described in any way.

To prevent leakage and evaporation during transport, vials containing liquid substances, such as, various biological, chemical, and/or cytobiological substances, including, for example, oligonucleotide samples, are typically frozen prior to shipment, placed within a thermal insulating material, and shipped with ice or other coolant. For many years, molded expanded polystyrene ("EPS") containers have been used as a thermal insulating material for biological sample shipments. One method of packaging vials containing frozen biological samples for shipment, for example, includes placing the vials within a standard matrix rack, and after loading, placing the matrix rack on a machine (i.e., a matrix barcode reader) that scans a barcode disposed on the bottom of each vile for product verification and tracking prior to shipment. For large numbers of vials (e.g., generally greater than 16), the matrix rack containing the vials may then be placed within an EPS container (i.e., cooler). For smaller vial shipments (e.g., generally less than or equal to 16 vials), the vials are typically removed from the matrix rack and placed in a secondary container and then in an EPS container. In either case, the loaded EPS container may then be placed within a cardboard or corrugated shipping box.

Environmental concerns regarding the use of EPS have arisen, including its poor volume efficiency resulting in a relatively large amount of packaging waste and its not being widely recyclable in numerous existing recycling facilities. Due to growing concerns for the environment, including for example concerns about global warming and excessive packaging waste, it may be desirable to provide packaging for transporting vials containing biological samples that reduces waste material and/or that is widely recyclable at recycling facilities. It may also be desirable to provide packaging that provides adequate protection for vials during transport at ambient temperatures, thus eliminating the need for costly thermal insulating materials altogether. It also may be desirable to provide packaging that simplifies the overall packaging workflow.

SUMMARY

The present teachings may solve one or more of the above-mentioned problems and/or may demonstrate one or more of the above-mentioned desirable features. Other features and/or advantages may become apparent from the description that follows.

In accordance with various exemplary embodiments of the present teachings, a packaging system for transporting vials containing biological samples may comprise a first tray defining at least one first tray cavity; and a second tray defining at least one second tray cavity and configured to mate with the first tray. The packaging system may further comprise at least one first tray cavity and at least one second tray cavity, wherein the at least one first tray cavity and the at least one second tray cavity are configured to securely hold respective vials for transport, and to restrain caps on the respective vials during transport, wherein the at least one first tray cavity and the at least one second tray cavity oppose each other when the first tray and the second tray are mated together. The packaging system may also be configured to permit barcode scanning of vials held within the first tray cavity and the second tray cavity.

In accordance with various additional exemplary embodiments of the present teachings, a method for packaging vials containing biological samples for transport may comprise disposing a vial containing a biological sample within a first tray cavity defined by a first tray, the first tray cavity securely holding the vial and restraining a cap on the vial; and disposing an additional vial containing a biological sample within a second tray cavity defined by a second tray, the second tray cavity securely holding the additional vial and restraining a cap on the additional vial. The method may further comprise mating the first tray with the second tray; and independently scanning a barcode on the vial within the first tray cavity and the vial within the second tray cavity.

Additional objects and advantages will be set forth in part in the description which follows, and in part will be obvious from the description, or may be learned by practice of the present teachings. The objects and advantages may be realized and attained by means of the elements and combinations particularly pointed out in the appended claims and their equivalents.

It is to be understood that both the foregoing general description and the following detailed description are exemplary and explanatory only and are not restrictive of the claims.

BRIEF DESCRIPTION OF THE DRAWINGS

The present teachings can be understood from the following detailed description either alone or together with the accompanying drawings. The drawings are included to provide a further understanding, and are incorporated in and constitute a part of this specification. The drawings illustrate one or more exemplary embodiments of the present teachings and together with the description serve to explain various principles and operations.

DESCRIPTION OF VARIOUS EXEMPLARY EMBODIMENTS

Vials containing liquid biological samples are typically frozen and packaged in materials that are often costly, bulky and/or difficult to recycle. Such materials, for example, may cost more to ship and require the use of relatively large amounts of coolant, while also generating relatively large amounts of often unrecyclable packaging waste. To increase shipping efficiency and the recyclability of packaging waste, various exemplary embodiments of the present teachings provide packaging systems and methods for transporting vials containing biological samples at ambient temperatures, eliminating the need for thermal insulating materials and reducing the overall amount and size of the packaging. In various exemplary embodiments, packaging systems and methods for transporting vials containing biological samples use a first tray defining at least one first tray cavity and a second tray defining at least one second tray cavity to securely hold vials for transport and to restrain caps on the vials during transport, wherein the packaging system also permits barcode scanning of the vials held within the trays.

Figure 1:
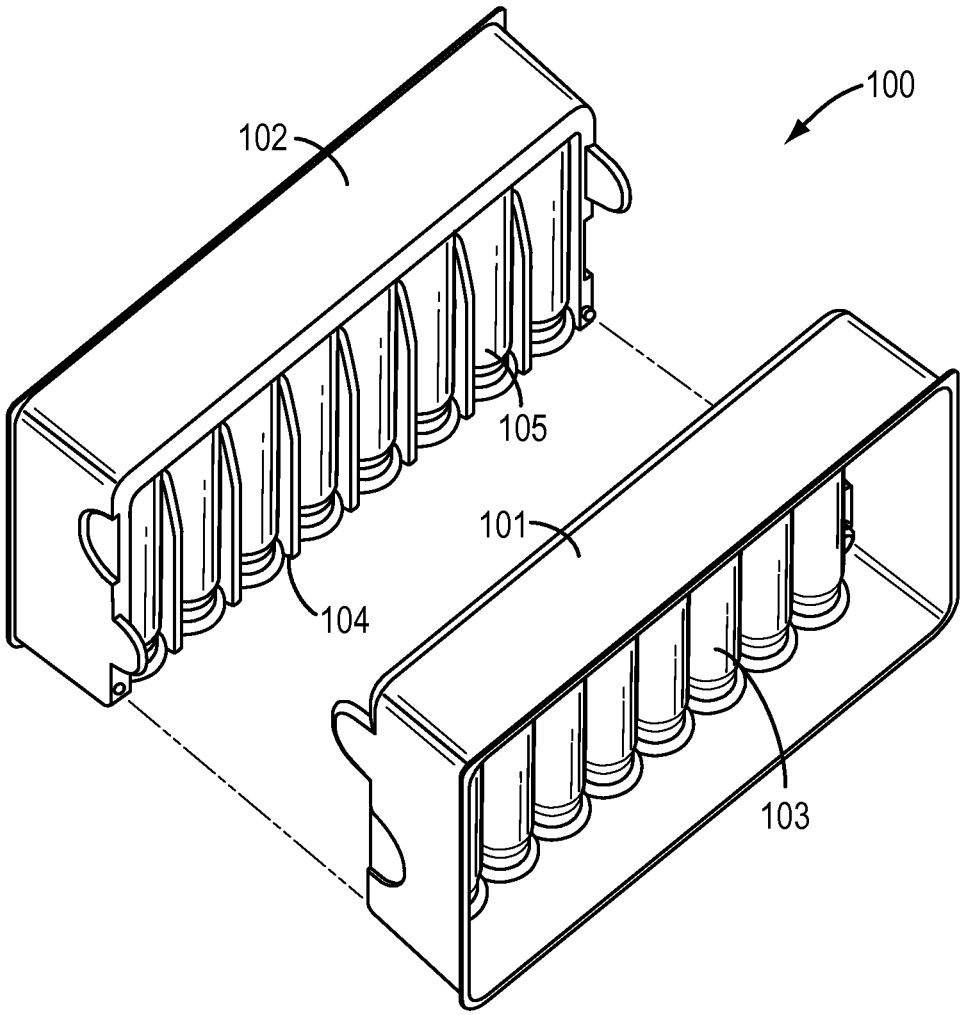
FIG. 1 illustrates an exemplary embodiment of a packaging system for transporting biological samples in accordance with the present teachings.

FIG. 1 illustrates an exemplary packaging system for transporting vials containing biological samples in accordance with exemplary embodiments of the present teachings. As shown in FIG. 1, a packaging system 100 may include a first tray 101 and a second tray 102.

The trays 101 and 102 may be formed from any material suitable for packaging vials for transport in accordance with the present teachings. In various exemplary embodiments, the trays 101 and 102 may comprise a thermoform plastic material, such as, for example, a polyethylene terephthalate (PET) material, made from recycled materials. The material of which the trays 101 and 102 are made may be transparent to allow visibility of the products through the packaging, and also to enhance the aesthetics of the packaging system. Those ordinarily skilled in the art will understand, however, that trays 101 and 102 may be formed from various plastic materials, including, for example, high and low-density polyethylene, polypropylene, polystyrene, polycarbonate, acrylate, polyvinyl chloride (PVC), Acrylonitrile butadiene styrene (ABS), cellulose, and/or nylon, as well as various other materials, including, for example, recycled paperboard and/or cardboard. In various additional exemplary embodiments, for example, the trays 101 and 102 may comprise a tinted or solid plastic material to better accommodate light sensitive products contained in the packaged vials.

Figure 2A:
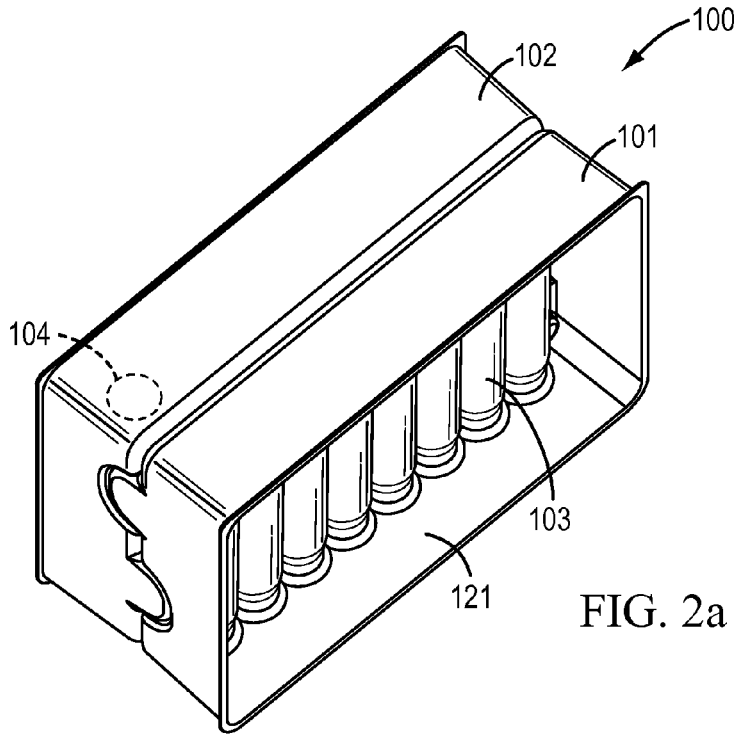
FIG. 2*a* illustrates the packaging system of FIG. 1 in a closed position.
Figure 2B:
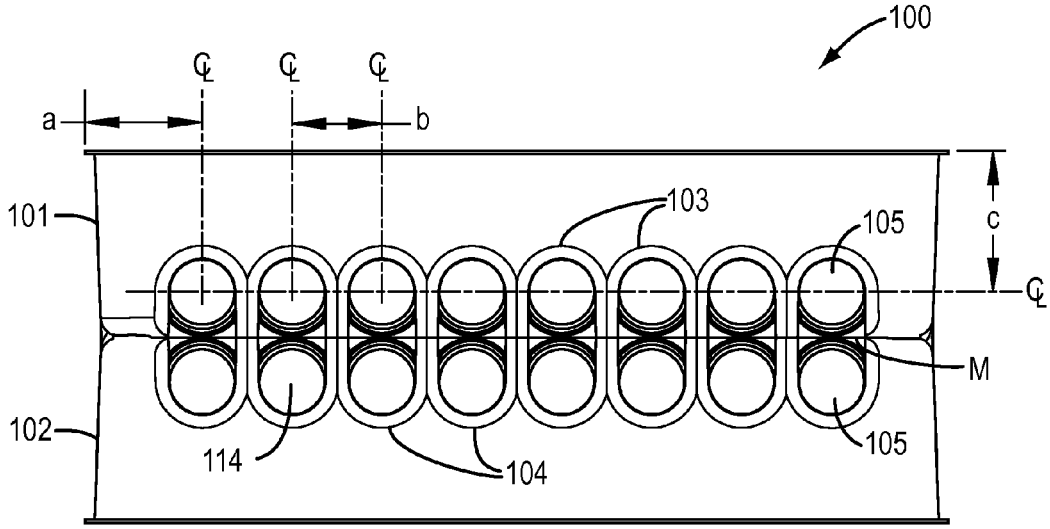
FIG. 2*b* is a bottom plan view of the packaging system of FIG. 2*a;*

The first tray 101 may define at least one first tray cavity 103 and the second tray 102 may define at least one second tray cavity 104. As shown in FIGS. 1, 2*a* and 2*b*, in various exemplary embodiments, the first tray 101 may define a plurality of first tray cavities 103 and the second tray 102 may define a plurality of second tray cavities 104. By way of non-limiting example, as also illustrated in FIGS. 1, 2*a* and 2*b*, the first tray 101 may define eight first tray cavities 103 and the second tray 102 may define eight second tray cavities 104. Those of ordinary skill in the art will understand, however, that trays 101 and 102 may define any number of cavities 103 and 104 without departing from the scope of the present teachings.

Figure 3:
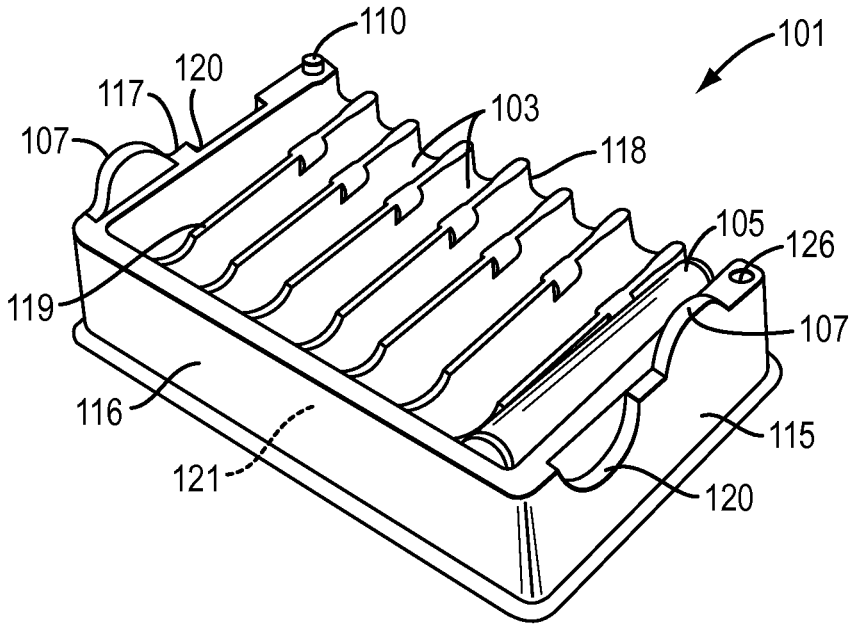
FIG. 3 illustrates an exemplary embodiment of a tray used in the packaging system of FIG. 1.

In various exemplary embodiments of the present teachings, as shown in FIG. 3 illustrating only the first tray 101 for simplicity, each of the first and second trays 101 and 102 comprises a wall 119 defining the first and second tray cavities 103 and 104 respectively, and four substantially planar side walls 115, 116, 117 and 118 extending from the wall 119. The wall 119 and the side walls 115, 116, 117 and 118 define a hollow chamber 121 (see FIG. 2*a*). Consequently, in various exemplary embodiments, the first and second trays 101 and 102 may act as a suspension system, with the planar side walls 115, 116, 117 and 118 absorbing shock to protect the first and second tray cavities 103 and 104 (and consequently vials held within the cavities) if the packaging system 100 is, for example, dropped or otherwise subject to relatively rigorous movement during transport.

Figure 5:
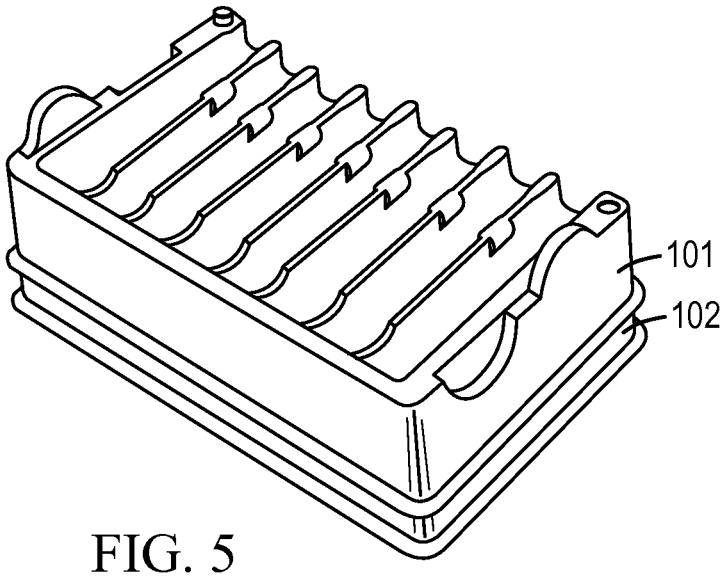
FIG. 5 illustrates another exemplary embodiment of a packaging system for transporting biological samples in accordance with the present teachings.

Further, in various exemplary embodiments, the first and second trays 101 and 102 can be arranged in a nesting configuration with one another, as illustrated in FIG. 5. That is, as shown in FIG. 5, the hollow chamber 121 of one tray 101 or 102 may be configured to receive the wall 119 and a portion of the walls 115, 116, 117, and 118 of another tray 101 or 102. Such a nesting configuration can reduce the overall profile of, and thus space occupied by, one or more empty packaging systems for storage and shipment, for example, as compared to the mated configuration of the first and second trays.

Figure 2C:
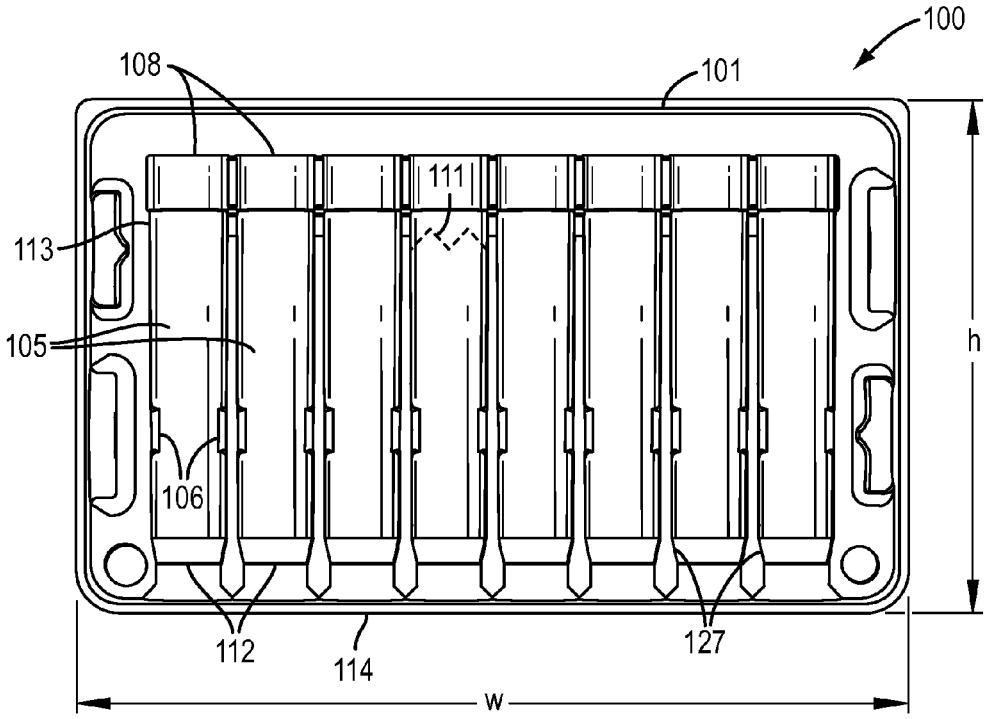
FIG. 2*c* is a front plan view of the packaging system of FIG. 2*a;*
Figure 7:
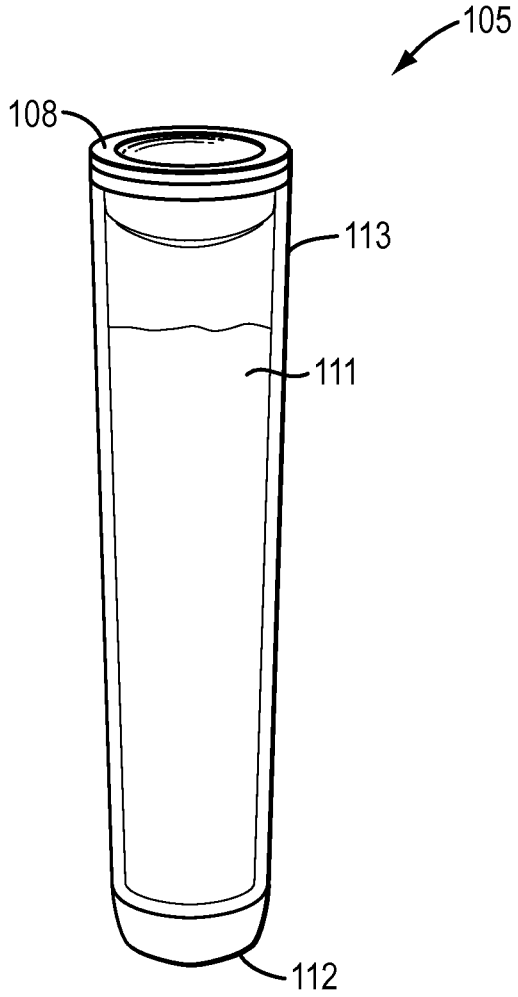
FIG. 7 illustrates an exemplary embodiment of a vial for transport in the packaging system of FIG. 1.

As shown in FIGS. 1, 2*b* and 2*c*, in various exemplary embodiments of the present teachings, the packaging system 100 may further comprise vials 105 held within the cavities 103 and 104. As shown in FIGS. 2*c* and 7, in various embodiments, for example, the vials 105 may contain a biological sample 111. As would be understood by those of ordinary skill in the art, the biological sample 111 may comprise various biological fluids, including, for example, nucleotides (including oligonucleotides), assays, viruses, bacteria, blood, and urine samples.

The vials 105 may comprise any type of cylinder, tube and/or other structure suitable for containing a biological sample for transport in accordance with the present teachings. By way of non-limiting example, the vials 105 may be polypropylene tubes, such as, for example, any of a variety of Matrix Storage Tubes commercially available from Thermo Scientific, a division of Thermo Fisher Scientific, Inc. of Hudson, N.H. Those ordinarily skilled in the art will understand, however, that the vials 105 may be formed from various materials, including, for example, a plastic and/or glass material, and that the type of material may be chosen based on application, cost, performance, and other such factors. Depending on a sample's tracking needs, those ordinarily skilled in the art will further understand that the vials 105 may be blank or include alphanumeric identifiers, such as, for example, barcodes adhered to the bottom of each vial. A non-limiting example of a suitable barcoded vial includes Matrix 2D Barcoded Storage Tubes commercially available from Thermo Scientific, a division of Thermo Fisher Scientific, Inc. of Hudson, N.H.

As further shown in FIG. 7, each vial 105 may include a cap 108. The cap 108 may, for example, be securely fit onto an open end 113 (i.e., a capped end) of the vial 105 to create a vapor barrier for the biological sample 111 held within the vial 105. Non-limiting examples of suitable caps include SepraSeal and DuraSeal caps commercially available from Thermo Scientific, a division of Thermo Fisher Scientific, Inc. of Hudson, N.H.

As further shown in FIGS. 2*b* and 2*c*, the first tray cavities 103 and the second tray cavities 104 are configured to securely hold respective vials 105 for transport, and to restrain caps 108 on the vials 105 during transport. In various exemplary embodiments, for example, cavities 103 and 104 are configured to hold the vials 105 and restrain the caps 108 via friction fit between the walls defining the cavities 103 and 104 and the outer surfaces of the vials 105 and caps 108. In various exemplary embodiments, the cavities 103 and 104 may include a tapered neck portion 127 just proximal the open end of the cavities 103 and 104. The tapered neck portion 127 may be configured to substantially correspond to the tapered end of the vials 105, thereby restricting vertical movement of a vial 105 toward open ends 114 of the cavities 103 and 104. This also serves to exert a compressive force on the vial 105 and cap 108 to help restrain the cap 108 on the vial 105 when the vial is seated within a cavity 103 or 104. As shown in FIG. 2*c*, in various additional exemplary embodiments, the first tray cavities 103 and the second tray cavities 104 may also include protrusions 106 to hold the vials 105 within the cavities 103 and 104. The protrusions 106 may be configured, for example, to extend slightly (e.g., a few millimeters) over each vial 105, thereby substantially restricting horizontal movement of the vial 105 once the vial 105 is snapped into place within a cavity 103 or 104. Those ordinarily skilled in the art will understand, however, that cavities 103 and 104 may hold vials 105 and restrain caps 108 in any number of ways without departing from the scope of the present teachings.

In various exemplary embodiments of the present teachings, the packaging system 100 may be configured to provide protection for vials 105 during transport such that biological samples contained in the vials 105 need not be frozen for shipment, but rather can be maintained at ambient temperature. As explained above, for example, the first tray cavities 103 and the second tray cavities 104 may be configured to hold the vials 105 to restrain caps 108 on the vials 105, thereby avoiding leakage of the samples from the vials 105 and permitting the samples to be in a liquid state, rather than a frozen state, during transport. This permits transport of the vials 105 at ambient temperatures without the need for any particular refrigeration or other cooling mechanisms, and/or thermal insulating materials (e.g., EPS containers) to maintain the samples contained in the vials 105 in a frozen state. Accordingly, in various exemplary embodiments, the vials 105 may contain an unfrozen (e.g., liquid) biological sample 111, that may be at ambient temperature. As used herein, the term "ambient temperature" or "ambient temperatures" refers to a surrounding environment temperature of the packaging system 100 in which the vials 105 containing biological samples 111 are stored and/or transported. As those having ordinary skill in the art would be familiar, ambient temperatures for a variety of transport conditions may be approximately average room temperatures, or somewhat higher or lower depending on outside air temperature conditions. In various exemplary embodiments, the packaging system 100 and the vials 105 with samples 111 therein may be transported at ambient temperature ranges, such as, for example, temperatures ranging from about 15° C. to about 30° C.

As shown in FIGS. 2*a* and 2*b*, the first tray 101 is configured to mate with the second tray 102 so that the first tray cavities 103 and the second tray cavities 104 oppose each other. As further shown in FIG. 2*d*, in various exemplary embodiments, the trays 101 and 102 can mate along a plane taken through a line P-P that is substantially parallel to a longitudinal axis of the first and second tray cavities 103 and 104. In other words, when holding vials 105, trays 101 and 102 can mate along a plane that is substantially parallel to a longitudinal axis of the vials 105. Those of ordinary skill in the art will understand that trays 101 and 102 can mate via any known fastening mechanism(s), including, for example, buttons, snaps, clips, mating friction fit portions on the trays, and/or adhesives.

Figure 4:
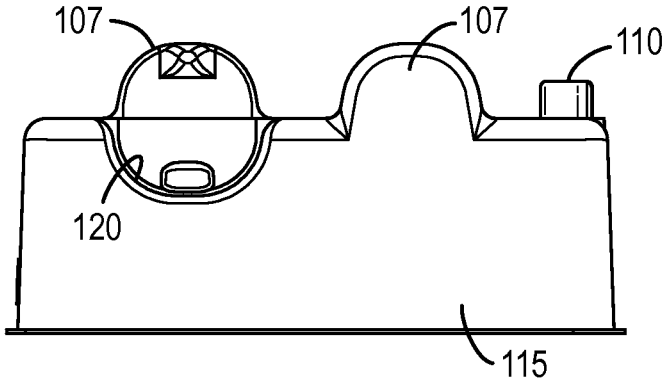
FIG. 4 is a side plan view of the tray of FIG. 3.

In various exemplary embodiments, to increase rigidity and reduce twisting of the packaging system 100 during transport, trays 101 and 102 are configured to securely mate via a snap mechanism as shown in FIG. 2*a*. As shown in FIGS. 3 and 4, by way of example, a snap mechanism may comprise engaging flaps 107 and receiving recesses 120, wherein engaging flaps 107 on each of the trays 101 and 102 are configured to respectively mate with corresponding receiving recesses 120 on each of the trays 101 and 102 (see FIG. 2*d*).

Figure 2D:
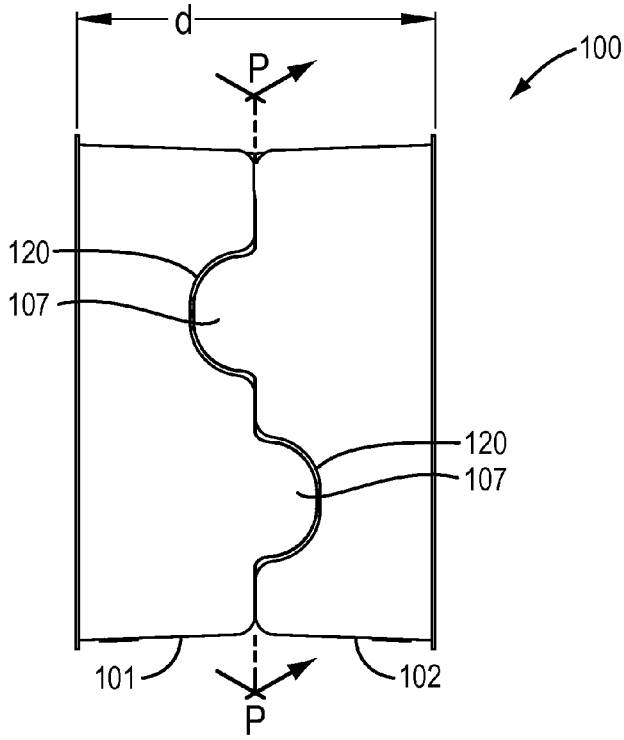
FIG. 2*d* is a side plan view of the packaging system of FIG. 2*a;*

In various embodiments, for example, each short side wall 115 and 117 may respectively include one engaging flap 107 (i.e., a protruding part) and one receiving recess 120 (i.e., a recessed part) as shown in FIGS. 3 and 4 for tray 101. Accordingly, when trays 101 and 102 are joined (i.e., the side wall 115 of tray 101 is joined with the side wall 117 of tray 102 and the side wall 117 of tray 101 is joined with the side wall 115 of tray 102), the engaging flaps 107 can overlap corresponding receiving recesses 120 to form a secure connection (e.g., a snap-fit) between the first tray 101 and the second tray 102 as illustrated in FIG. 2*d*. In various embodiments, the overlapping nature of the snap mechanism (i.e., the snap-fit connection between the engaging flaps 107 and the receiving recesses 120) may provide increased stability by reducing twisting of the packaging system 100. Furthermore, in various embodiments, the positioning of the snap mechanism (i.e., the position of the engaging flaps 107 and the receiving recesses 120 on the short side walls 115 and 117) may further prevent horizontal rotation (i.e., twisting about a plane perpendicular to a longitudinal axis of the first and second tray cavities 103 and 104).

As also shown in FIGS. 3 and 4, the snap mechanism may further comprise engaging buttons 110 and receiving depressions 126 (see FIG. 4), wherein an engaging button 110 on each of the trays 101 and 102 is configured to mate with a corresponding receiving depression 126 on each of the trays 101 and 102. In various embodiments, for example, each side wall 117 may include one engaging button 110 (i.e., a protruding part) and each side wall 115 may include one receiving depression 126 (i.e., a recessed part) as shown in FIG. 3 for tray 101. Accordingly, when trays 101 and 102 are joined (i.e., the side wall 115 of tray 101 is joined with the side wall 117 of tray 102 and the side wall 117 of tray 101 is joined with the side wall 115 of tray 102), the engaging buttons 110 can snap with corresponding receiving depressions 126 to form a secure connection (e.g., a snap-fit) between the first tray 101 and the second tray 102 as illustrated in FIG. 2*d*. In various embodiments, the position of the buttons 110 and the depressions 126 proximate to the bottom portion of the short side walls 117 and 115 may provide increased rigidity to the packaging system 100.

Those ordinarily skilled in the art will understand, however, that the snap mechanism may include a variety of different components in a variety of different positions without departing from the scope of the present teachings.

For quality assurance purposes, the packaging system 100 is further configured to permit barcode scanning of the vials 105 held within the cavities 103 and 104. By way of non-limiting example, the packaging system 100 is configured for placement on a barcode scanner, such as, for example, a high speed 2D barcode reader commercially available from Thermo Scientific, a division of Thermo Fisher Scientific, Inc. of Hudson, N.H. Consequently, in various exemplary embodiments of the present teachings, the packaging system has a height h of about 2.08 inches (see FIG. 2*c*), a width w of about 3.36 inches (see FIG. 2*c*) and a depth d of about 1.45 inches (see FIG. 2*d*). Those ordinarily skilled in the art would understand, however, that the size and/or dimensions of the packaging system 100 can be chosen based on the scanner configuration used, vials being transported, cost to make and/or ship, and other such factors.

As shown in FIG. 2*b*, to facilitate barcode scanning, in various exemplary embodiments, the cavities 103 and 104 are open at an end thereof. For example, the cavities 103 and 104 can be open at an end 114 to permit barcode scanning of each vial 105 at an end 112 of each vial 105 opposite a capped end 113 (see FIGS. 2*c* and 7). Thus, in various exemplary embodiments, the cavities 103 and 104 are open at a bottom end to permit the scanning of a barcode on the bottom of each vial 105 when the packaging system 100 is placed upon a barcode scanner as described above. As further shown in FIG. 2*b*, in various additional exemplary embodiments, the cavities 103 and 104 are arranged to permit individual barcode scanning of respective vials 105 held within each cavity. Consequently, in various exemplary embodiments, the cavities 103 and 104 are arranged with a distance a of about 0.46 inches, a distance b of about 0.35 inches and a distance c of about 0.55 inches, for placement on a barcode scanner, such as, for example, the above high speed 2D barcode reader, which may simultaneously scan a barcode on each vial 105. Those ordinarily skilled in the art would understand, however, that the size, dimension and/or arrangement of the cavities can be chosen based on the scanner configuration used, the vials being transported, and other such factors.

Figure 6:
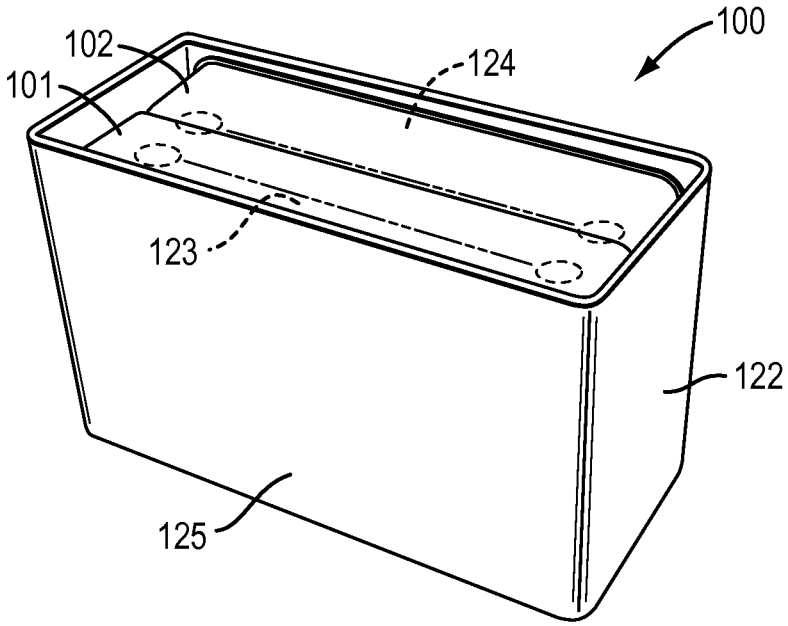
FIG. 6 illustrates a nesting configuration of trays in accordance with the present teachings.

As illustrated in FIG. 6, in various exemplary embodiments of the present teachings, the packaging system 100 may further comprise a sleeve 122 configured to receive the mated first and second trays 101 and 102, which in turn may hold vials 105 in their respective cavities 103 and 104. In various exemplary embodiments, when the mated first and second trays 101 and 102 are received in the sleeve 122, as shown in FIG. 6, a first air pocket 123 is defined between the first tray 101 and the sleeve 122, and a second air pocket 124 is defined between the second tray 102 and the sleeve 122. As would be understood by those of ordinary skill in the art, the first and second air pockets 123 and 124 can provide a cushioning effect (e.g., to help prevent breakage) and/or insulation (e.g., to act as thermal buffers) for the vials 105 held within the first and second tray cavities 103 and 104 during transport. In various additional exemplary embodiments, product labeling, including, for example, content and/or instructional information, can be affixed to an outer surface 125 of the sleeve 122.

The sleeve 122 may comprise any carton, box and/or other structure suitable for receiving and holding the mated first and second trays 101 and 102. For environmental purposes (e.g., including ease of recycling), for example, in various exemplary embodiments, the sleeve 122 may be a standard paperboard sleeve, for example, made from recycled materials. Those ordinarily skilled in the art will understand, however, that sleeve 122 may be formed from various materials, including, for example, recycled paper, plastic and/or a wood material. Those ordinarily skilled in the art would further understand that the size and/or configuration of sleeve 122 can be chosen based on the size of the mated trays, cost to make and/or ship, efficiency, and other such factors.

As shown in FIG. 6, the sleeve 122 may be formed by four planar side walls (e.g., two opposing short side walls and two opposing long side walls), and may be open at its top and bottom (in the orientation shown in FIG. 6). Providing an open bottom may permit the vials 105 packaged in the trays 101 and 102 to be scanned by a barcode scanner while held in the sleeve 122. In various alternative embodiments (not shown), the sleeve may include other walls, such as a top wall and/or a bottom wall, or may include covers configured to fold over the top and/or bottom walls to permit access to the trays 101 and 102 inside. Those ordinarily skilled in the art are familiar with various outer sleeve assemblies that may be suitable for holding the trays 101 and 102. In various exemplary embodiments of the present teachings, the sleeve 122 is configured to activate a barcode scanner, for example, when the packaging system 100 is placed on the scanner. The sleeve 122 can activate a barcode scanner by acting as an opaque barrier to interrupt a sensor light on the scanner.

In accordance with various exemplary embodiments of the present teachings, an exemplary method for packaging vials containing biological samples for transport, as illustrated in FIGS. 1 and 2*a*-2*d* will now be described. A vial 105 containing a biological sample 111 may, for example, be disposed within a first tray cavity 103 defined by a first tray 101. The first tray cavity 103 may securely hold the vial 105 and restrain a cap 108 on the vial 105. Similarly, an additional vial 105 containing a biological sample 111 may be disposed within a second tray cavity 104 defined by a second tray 102, and the second tray cavity 104 may securely hold the additional vial 105 and restrain a cap 108 on the additional vial 105.

Various exemplary embodiments contemplate disposing vials 105 containing biological samples 111 in an unfrozen (e.g., liquid) state and at an ambient temperature within the cavities 103 and 104, and transporting the vials 105 in the packaging system 100 at ambient temperature.

Various exemplary embodiments of the present teachings contemplate, for example, disposing the vials 105 within the first and second tray cavities 103 and 104 while the trays 101 and 102 are placed in a horizontal position (i.e., the longitudinal axis of the cavities 103 and 104, and thus a vial received therein is horizontal relative to the ground), as shown in FIG. 3 illustrating the first tray 101. Various additional exemplary embodiments further contemplate substantially wholly disposing the vials 105 within the first and second tray cavities 103 and 104. In other words, a vial 105 may be wholly disposed within a cavity such that substantially no portion of the vial 105 extends beyond a plane of the wall 119 (or the mid-plane M of the mated trays 101 and 102 as shown in FIG. 2*b*).

As illustrated in FIG. 1, various exemplary embodiments of the present teachings further contemplate respectively disposing a plurality of vials 105 containing a biological sample 111 in a plurality of first tray cavities 103 defined by the first tray 101, and respectively disposing a plurality of additional vials 105 containing a biological sample 111 in a plurality of second tray cavities 104 defined by the second tray 102. Various exemplary embodiments consider, for example, respectively disposing less than or equal to eight vials 105 in less than or equal to eight first tray cavities 103, and respectively disposing less than or equal to eight additional vials 105 in less than or equal eight second tray cavities 104.

As shown in FIGS. 2*a* and 2*b*, the first tray 101 can then be mated to the second tray 102, so that the first tray cavity 103 and the second tray cavity 104 oppose each other. Various exemplary embodiments contemplate, for example, mating the first tray 101 with the second tray 102 by snapping the first tray 101 to the second tray 102 as described above with regard to FIGS. 2*d*, 3 and 4. Various exemplary embodiments contemplate overlapping engaging flaps 107 (i.e., protruding parts on the trays 101 and 102) with corresponding receiving recesses 120 (i.e., recessed parts on the trays 101 and 102) to form a secure connection (e.g., a snap-fit) between the first tray 101 and the second tray 102 as illustrated in FIG. 2*d*. Various additional exemplary embodiments further contemplate snapping engaging buttons 110 (i.e., protruding buttons on the trays 101 and 102) into receiving depressions 126 (i.e., button holes on the trays 101 and 102) to further increase the rigidity of the packaging system 100.

As illustrated in FIG. 6, to protect and insulate the vials 105, various exemplary embodiments also consider disposing the mated first and second trays 101 and 102 within a sleeve 122, thereby forming a first air pocket 123 between the first tray 101 and the sleeve 122 and a second air pocket 124 between the second tray 102 and the sleeve 122. Various exemplary embodiments, for example, contemplate that the first and second air pockets 123 and 124 create a thermal buffer for the vials 105 disposed within the first and second tray cavities 103 and 104.

As part of a quality control check prior to transport (e.g., to identify and track the samples being shipped), a barcode disposed on the bottom end of each vial 105 within the first and second tray cavities 103 and 104 can be independently scanned, as those ordinarily skilled in the art are familiar. By way of example, as above, the mated first and second trays 101 and 102 holding vials 105 can be placed on a barcode scanner, such as, for example, a high speed 2D barcode reader. Various exemplary embodiments consider individually scanning each vial 105 within the package 100 one at a time, whereas various additional exemplary embodiments consider scanning the entire package of vials 105 at once.

Various exemplary embodiments of the present teachings then contemplate transporting the vials 105 at ambient temperatures. As above, various exemplary embodiments, for example, contemplate transporting the vials 105 at a temperature in the range of from about 15° C. to about 30° C., thus eliminating the need for thermal insulating materials and/or special refrigerant/coolant mechanisms during transport.

To verify that the systems and methods in accordance with exemplary embodiments of the present teachings can provide adequate protection for vials containing biological samples during transport at ambient temperatures, several experiments were conducted with the results being illustrated in FIGS. 8*a* through 9*b*.

In the experiments, vials containing oligonucleotide samples (an AbD Gene Expression assay with a fill volume of 1000 μL and a miRNA TaqMan assay with a fill volume of 188 μL) were packaged for ambient transport using thermoform plastic trays as described above with reference to FIG. 1 (plastic), a paperboard box (paper), and a standard matrix rack (rack). Each packaging system was then placed within a cardboard box and run through a series of distribution environment tests, including an ambient temperature profile test and a distribution transit test. The ambient temperature profile test included a six day (144 hour) global summer shipping simulation cycle, in which the temperature was maintained between 20° C. and 30° C. and the humidity was uncontrolled. The distribution transit test simulated mechanical shock (i.e., drops), vibration profiles (e.g., truck and aircraft) and altitude variations (i.e., a 10,000 ft road elevation and a 14,000 ft aircraft elevation) experienced by packages during transport.

After testing, the vials were submitted for post-test inspection and analysis. Upon visual inspection, there was no physical damage to the vials (i.e., there was no visible leakage) and all vial caps appeared intact.

Figure 8A:
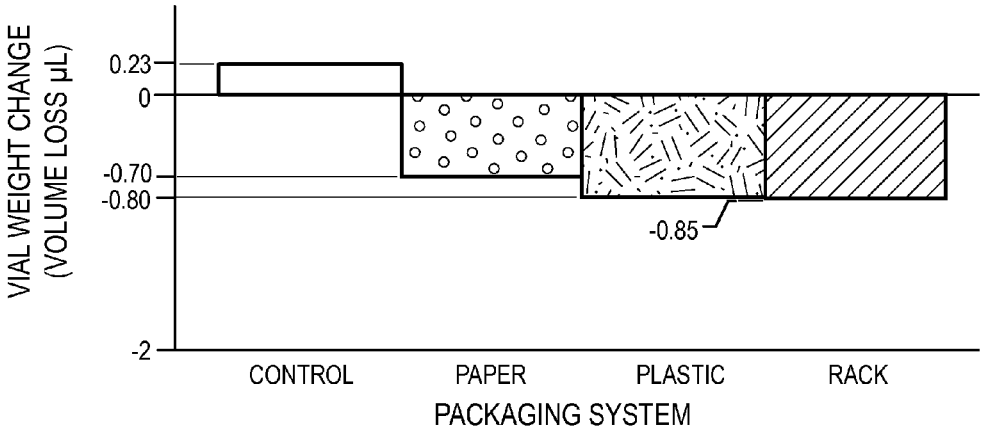
FIGS. 8*a* and 8*b* are graphs illustrating weight changes of biological samples after ambient shipment using various packaging materials.
Figure 8B:
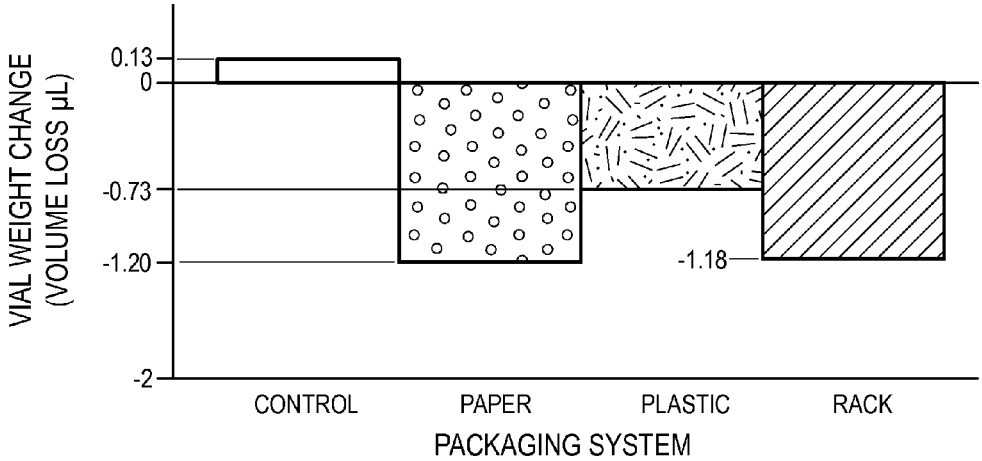

To determine the post-shipment volume loss for each test sample, the post-test filled vial weight of each assay was measured by a quantitation analysis method, as would be understood by those ordinarily skilled in the art, and compared to a pre-test filled vial weight. The vial weight change (volume loss in μL) for each test sample, as compared to a control (i.e., a set of vials containing frozen samples maintained at −20° C.), was plotted for each packaging system in FIGS. 8*a* (for AbD Gex) and 8*b* (for miRNA). As shown in FIGS. 8*a* and 8*b*, for each packaging system tested, each oligonucleotide sample lost approximately 1 μL during the simulated ambient shipment.

Figure 9A:
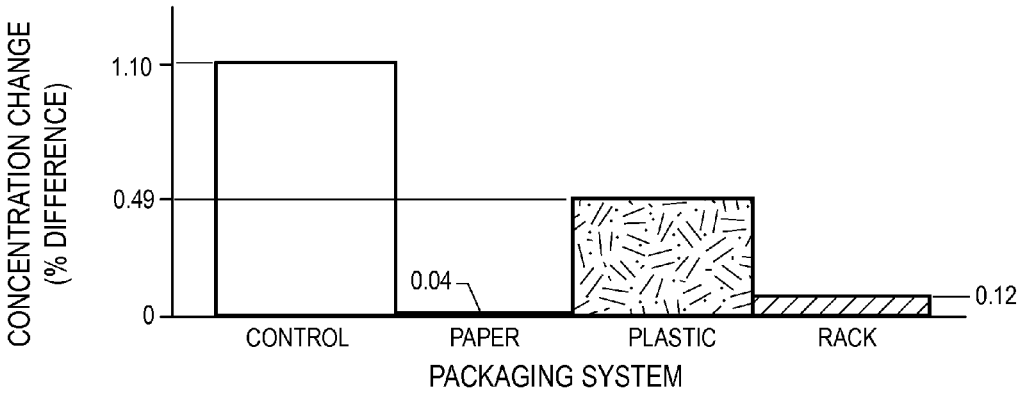
FIGS. 9*a* and 9*b* are graphs illustrating concentration changes of biological samples after ambient shipment using various packaging materials.
Figure 9B:
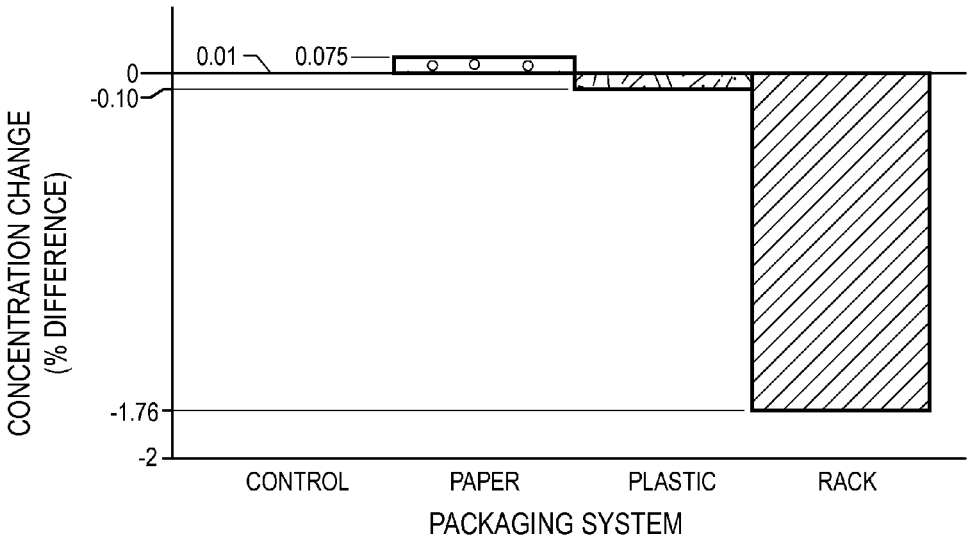

To determine if the volume loss resulted in a significant concentration change, the post-test concentration (i.e., post-shipment concentration) of each assay was also measured by a gravimetric method, as would be understood by those ordinarily skilled in the art, and compared to a pre-test concentration. The concentration change (% difference) for each test sample, as compared to the control, was plotted for each packaging system in FIGS. 9*a* (for AbD Gex) and 9*b* (for miRNA). As shown in FIGS. 9*a* and 9*b*, for each packaging system, the concentration change after simulated ambient shipment is comparable between the control and the test samples, that is, they were all within an acceptance criteria of +/−10% of the target concentration. In particular, for the plastic packaging system, the concentration change was relatively minuscule, resulting in a 0.49% difference for the AbD Gex sample and a −0.10% difference for the for the miRNA sample.

Accordingly, the data presented in FIGS. 8*a* through 9*b* demonstrates that the packaging systems and methods in accordance with exemplary embodiments of the present teachings can provide adequate protection for vials containing biological samples during transport at ambient temperatures.

It will be appreciated by those ordinarily skilled in the art having the benefit of this disclosure that the present teachings provide various exemplary systems and methods for packaging vials for transport, for example, for packaging vials containing substances useful for biological, chemical, and/or cytobiological applications. Further modifications and alternative embodiments of various aspects of the present teachings will be apparent to those skilled in the art in view of this description. For example, the systems and the methods may include additional components or steps that were omitted from the drawings for clarity of illustration and/or operation. Accordingly, this description is to be construed as illustrative only and is for the purpose of teaching those skilled in the art the general manner of carrying out the present teachings. It is to be understood that the various embodiments shown and described herein are to be taken as exemplary. Elements and materials, and arrangements of those elements and materials, may be substituted for those illustrated and described herein, parts and processes may be reversed, and certain features of the present teachings may be utilized independently, all as would be apparent to one skilled in the art after having the benefit of the description herein. Changes may be made in the elements described herein without departing from the spirit and scope of the present teachings and following claims, including their equivalents.

It is to be understood that the particular examples and embodiments set forth herein are non-limiting, and modifications to structure, dimensions, materials, and methodologies may be made without departing from the scope of the present teachings.

For the purposes of this specification and appended claims, unless otherwise indicated, all numbers expressing quantities, percentages or proportions, and other numerical values used in the specification and claims, are to be understood as being modified in all instances by the term "about" if they are not already. Accordingly, unless indicated to the contrary, the numerical parameters set forth in the following specification and attached claims are approximations that may vary depending upon the desired properties sought to be obtained by the present teachings. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It should be understood that while the present teachings have been described in detail with respect to various exemplary embodiments thereof, it should not be considered limited to such, as numerous modifications are possible without departing from the broad scope of the appended claims, including the equivalents they encompass.

We claim:

1. A method for packaging vials containing biological samples for transport, the method comprising:

disposing a vial securely fit with a cap containing a biological sample within a first tray cavity defined by a first tray;

disposing an additional vial securely fit with an additional cap containing a biological sample within a second tray cavity defined by a second tray;

providing a friction fit between the first tray cavity and the vial and the first tray cavity and the cap, and between the second tray cavity and the additional vial and the second tray cavity and the additional cap;

mating the first tray with the second tray;

independently scanning a barcode on the vial within the first tray cavity and the vial within the second tray cavity; and disposing the mated first and second trays within a sleeve, wherein disposing the mated first and second trays within a sleeve comprises forming a first air pocket between the first tray and the sleeve and a second air pocket between the second tray and the sleeve.

2. The method of claim 1, wherein forming the first and second air pockets respectively creates a thermal buffer for the vials disposed within the first and second tray cavities.

3. The method of claim of claim 1, wherein disposing the vials containing a biological sample within the first and second tray cavities comprises disposing vials containing a liquid biological sample within the first and second tray cavities.

4. The method of claim 1, wherein disposing the vials containing a biological sample within the first and second tray cavities comprises disposing vials containing a biological sample at ambient temperature within the first and second tray cavities.

5. The method of claim 1, wherein disposing the vials containing a biological sample within the first and second tray cavities comprises laterally disposing the vials within the first and second tray cavities.

6. The method of claim 5, wherein disposing the vials containing a biological sample within the first and second tray cavities comprises substantially wholly disposing the vials within the first and second tray cavities.

7. The method of claim 1, wherein disposing the vial containing a biological sample comprises respectively disposing a plurality of vials containing a biological sample in a plurality of first tray cavities defined by the first tray, and wherein disposing the additional vial containing a biological sample comprises respectively disposing a plurality of additional vials containing a biological sample in a plurality of second tray cavities defined by the second tray.

8. The method of claim 1, wherein mating the first tray with the second tray comprises snapping the first tray to the second tray.

9. The method of claim 1, further comprising transporting the vials in the first and second tray cavities at ambient temperature.

10. The method of claim 1, further comprising independently scanning a barcode on the bottom of the vial within the first tray cavity and the vial within the second tray cavity.

* * * * *